US006857424B1

(12) United States Patent
Payne

(10) Patent No.: US 6,857,424 B1
(45) Date of Patent: Feb. 22, 2005

(54) ADJUSTABLE PITCHING PLATFORM

(76) Inventor: Jeffrey J. Payne, 4070 Seville Ave., Cocoa, FL (US) 32926

( * ) Notice: Subject to any disclaimer, the term of this patent is extended or adjusted under 35 U.S.C. 154(b) by 0 days.

(21) Appl. No.: 10/422,168

(22) Filed: Apr. 24, 2003

(51) Int. Cl.[7] ..... F41B 4/00
(52) U.S. Cl. ..... 124/78; 124/6
(58) Field of Search ..... 124/6, 78

(56) References Cited

U.S. PATENT DOCUMENTS 3,288,421 A 11/1966 Peterson ..... 248/396
3,669,451 A 6/1972 Welbourn ..... 273/95
3,713,653 A 1/1973 Romans ..... 272/57
3,724,437 A * 4/1973 Halstead
3,774,584 A * 11/1973 Paulson
3,777,732 A * 12/1973 Holloway et al.
3,784,193 A 1/1974 Simjian ..... 272/68
3,811,421 A * 5/1974 Betten
4,313,603 A 2/1982 Simjian ..... 272/146
4,391,441 A 7/1983 Simjian ..... 272/126
4,442,823 A * 4/1984 Floyd et al.
4,763,151 A 8/1988 Klinger ..... 354/293
5,125,653 A * 6/1992 Kovacs et al.
5,221,242 A 6/1993 Weber et al. ..... 482/79
5,437,261 A * 8/1995 Paulson et al.
5,464,208 A * 11/1995 Pierce
5,941,807 A 8/1999 Cassidy et al. ..... 482/146
6,082,350 A * 7/2000 Crews et al.

* cited by examiner

*Primary Examiner*—John A. Ricci
(74) *Attorney, Agent, or Firm*—Brian S. Steinberger; Law Offices of Brian S. Steinberger, P.A.

(57) ABSTRACT

Adjustable pitching platform allows for users such as coaches to automatically and selectively adjust trajectories of balls being pitched by ball dispensing machines. The platform can be positioned beneath a stand for supporting machines for dispensing balls, such as softballs, baseballs, and tennis balls. The platform can have two sandwiched layers with the top layer have a rearward extending tab. The top layer can pivot up and down relative to the bottom layer, and the top layer can also swivel relative to the bottom layer, so that depressing the tab raises the front of the pitching machine, and moving the tab side-to-side rotates the pitching machine for changing the pitched ball trajectories over the vertical and horizontal axes. The platform allows for the machine to continuously pitch balls along different trajectories between each of the pitches without having to physically handle and move the machine, and without causing delay times between the pitched balls.

18 Claims, 10 Drawing Sheets

ADJUSTABLE PITCHING PLATFORM

This invention relates to ball dispensing machines, in particular to a novel platform stand that is easily adjustable by a user's foot for changing trajectories along vertical and/or horizontal axes of pitched balls being dispensed by ball dispensing machines for softballs, baseballs, and tennis balls.

BACKGROUND AND PRIOR ART

Ball dispensing machines for softballs and baseballs have become more and more popular in recent years. The typical ball dispenser allows for someone such as a coach/helper to stand behind the dispenser which is usually mounted on a tripod type stand and feed balls into the dispenser which are automatically pitched along a trajectory line to a batter. Batters practice hitting the pitched balls to develop their skills. Typically, once the pitching machine is set up, the coach must manually adjust the pitching machine either by mechanically rising or lowering the head of the pitching machine for vertical trajectory. For horizontal trajectory the entire pitching machine must be lifted and rotated left or right to achieve the desired location of the pitch. Changing this trajectory line allows the batter to hit the ball at different locations to gain better batting versatility. However, once these mechanical adjustments are made, the user must verify the trajectory of the pitched ball to insure it is in the desired location, resulting in loss of hitting time for each batter. The combination of downtime and manual adjustments results in rare changes to the pitching machine since it is undesirable to do so. Thus, batters usually are stuck with hitting balls along the same pitched trajectory.

Several United States patents are considered relevant to this matter. See U.S. Pat. Nos. 3,288,421 to Peterson; 3,669,451 to Welbourn; 3,713,653 to Romans; 3,784,193 to Simjian; 4,313,603 to Simjian; 4,391,441 to Simjian; 4,763,151 to Klinger; 5,221,242 to Weber et al.; and 5,941,807 to Cassidy et al. However, none of these patents solves all the problems with the prior art described above.

SUMMARY OF THE INVENTION

The first objective of the present invention is to provide a stand for supporting a ball pitching machine for dispensing balls such as softballs, baseballs, and tennis balls, that can adjust ball trajectory delivery with the foot of a user.

The second objective of the present invention is to provide a stand for supporting a ball pitching machine for dispensing balls such as softballs, baseballs, and tennis balls, that can change the ball trajectory height without having to mechanically adjust the stand.

The third objective of the present invention is to provide a stand for supporting a ball pitching machine for dispensing balls such as softballs, baseballs, and tennis balls, that can change the ball trajectory angle without having to mechanically adjust the stand.

The pitching platform can be used in conjunction with a pitching machine, either a softball or baseball machine, which allows the user to select the desired pitch location without the constant need of handling a physical adjustment or speed changes to the pitching machine. Through a simple movement of the operator's/coach's foot one can change the pitch location from inside to outside, high to low, virtually anywhere within the strike zone, and/or adjust to throw outside the strike zone. All of this occurs without missing a single pitch. No more batting practice time is wasted by having to constantly setting up the pitching machine, only to stop and readjust the machine to a different pitch location while the player and the rest of the team waits. The novel platform increases performance in hitting when batters see pitches thrown throughout the strike zone rather then the same pitch over and over again.

An operator/coach can selectively adjust a platform beneath the machine by moving their foot up and down, and right and left onto a kickboard connected to the platform underneath the machine. The machine can pivot up or down and/or swivel to the right or left by the moving platform which effectively changes the vertical and/or horizontal trajectories of the balls being pitched by the machine to the batter. The batter gains greater versatility in being able to hit pitches along different trajectories one after the other without delays between the pitched balls.

Another embodiment uses the foot adjusted platform with a tennis ball dispensing machine, so that tennis players gain greater versatility in hitting tennis balls coming in from different trajectories one after the other without delays between the dispensed balls.

Further objects and advantages of this invention will be apparent from the following detailed description of presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its application to the details of the particular arrangement shown since the invention is capable of other embodiments. Also, the terminology used herein is for the purpose of description and not of limitation.

First Embodiment

Figure 1:
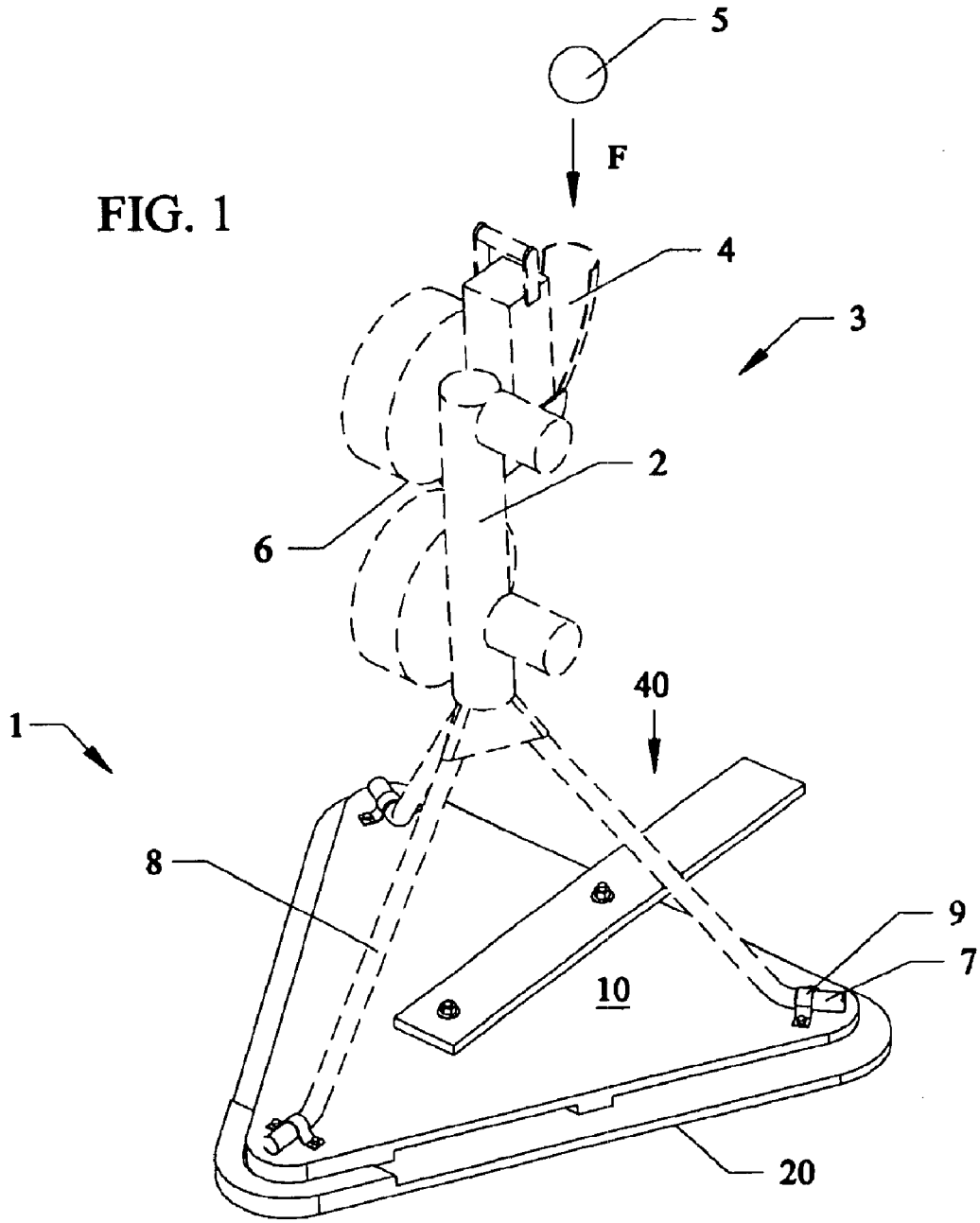
FIG. 1 is a front perspective view of a first embodiment pitching stand platform with ball dispenser.
Figure 2:
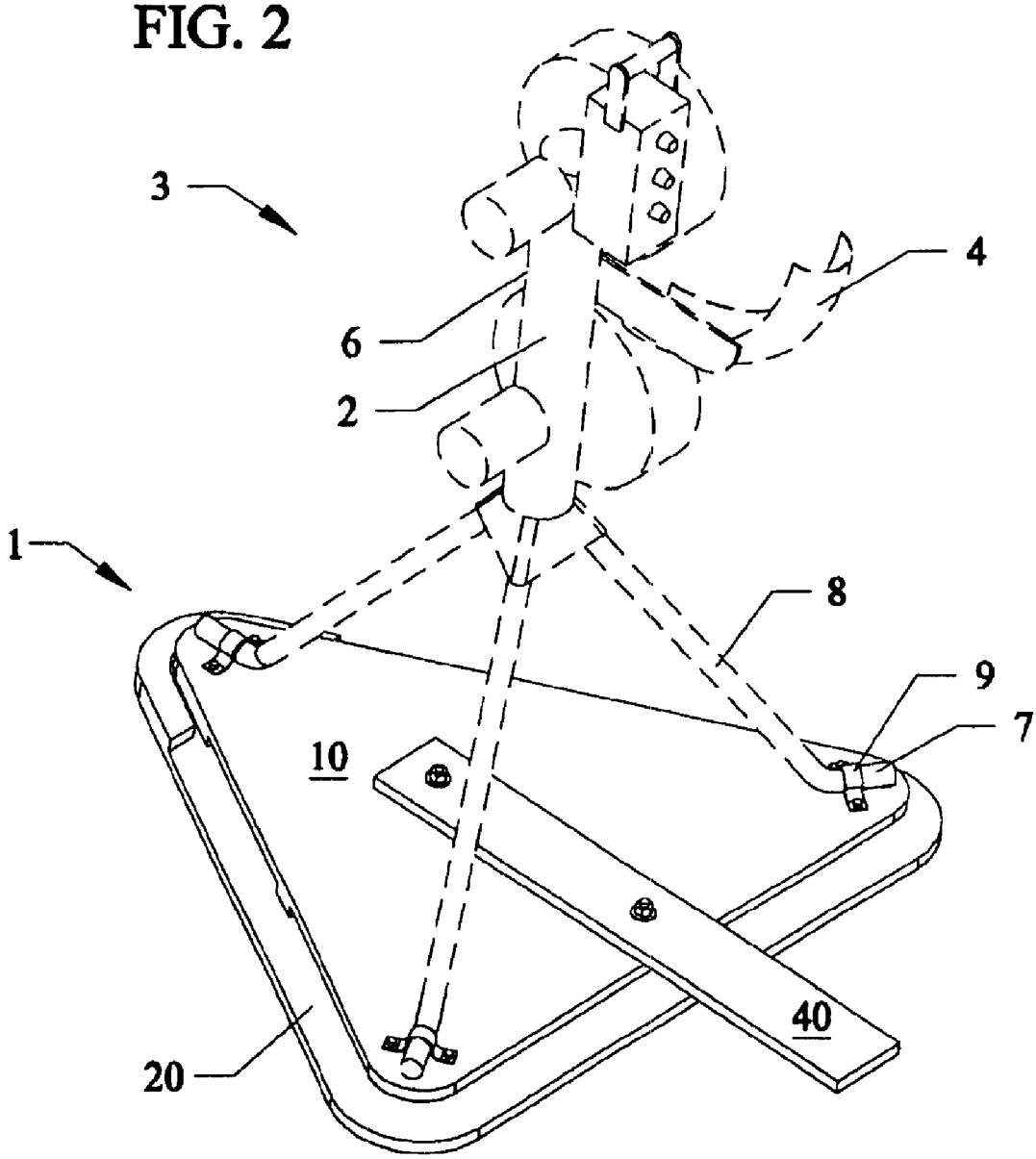
FIG. 2 is a rear perspective view of the pitching stand platform of FIG. 1.

FIG. 1 is a front perspective view of a first embodiment pitching stand platform 1 with ball dispenser 3 mounted thereon. FIG. 2 is a rear perspective view of the pitching stand platform 1 of FIG. 1. The ball dispensing machine 3 can include a feeder 4, ball pitching mechanism 6 on a main mast member 2 which can be supported off a ground surface by legs 8 such as a tripod leg arrangement having bent foot ends 7. The ball dispensing machine can be a typical automated dispensing machine according to the prior art which can be electrically powered to dispense balls out an output portion of the dispensing mechanism 6, when balls 5, such as softballs, baseballs, and the like, are fed by a user such as a coach into the feeder 4. The bent foot ends 7 of the legs 8 can be mounted to an upper triangular member 10 by fasteners 9, such as clamps, straps, and the like.

Figure 3:
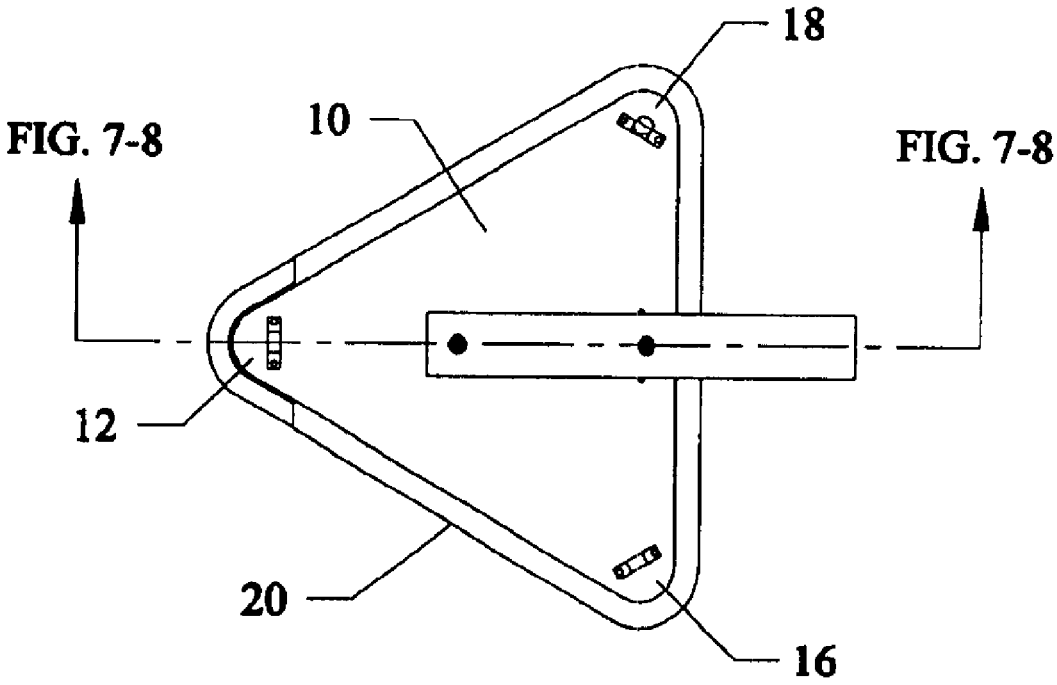
FIG. 3 is a top view showing the upper triangular member of the pitching stand platform of FIGS. 1–2.
Figure 4:
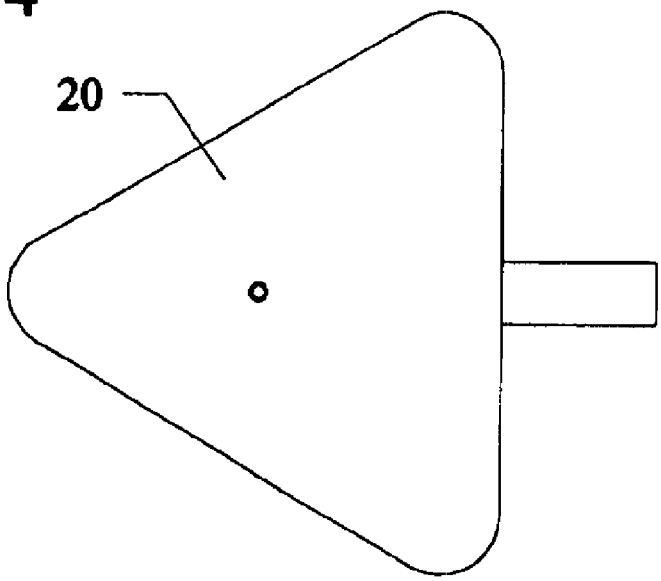
FIG. 4 is a bottom view of the lower triangular member of the pitching stand platform of FIGS. 1–2.
Figure 5:
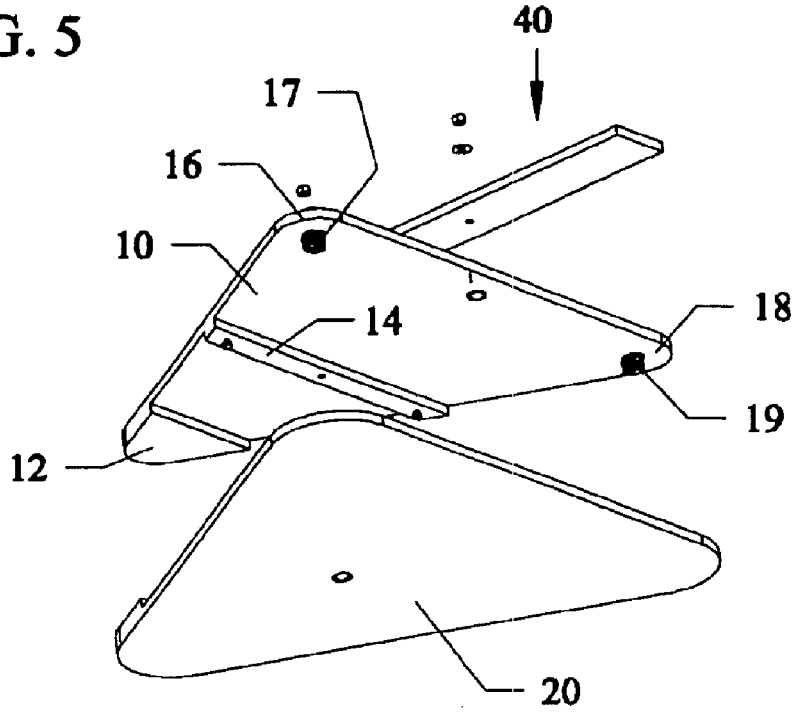
FIG. 5 is an exploded bottom perspective view of the pitching platform of FIGS. 1–4.
Figure 6:
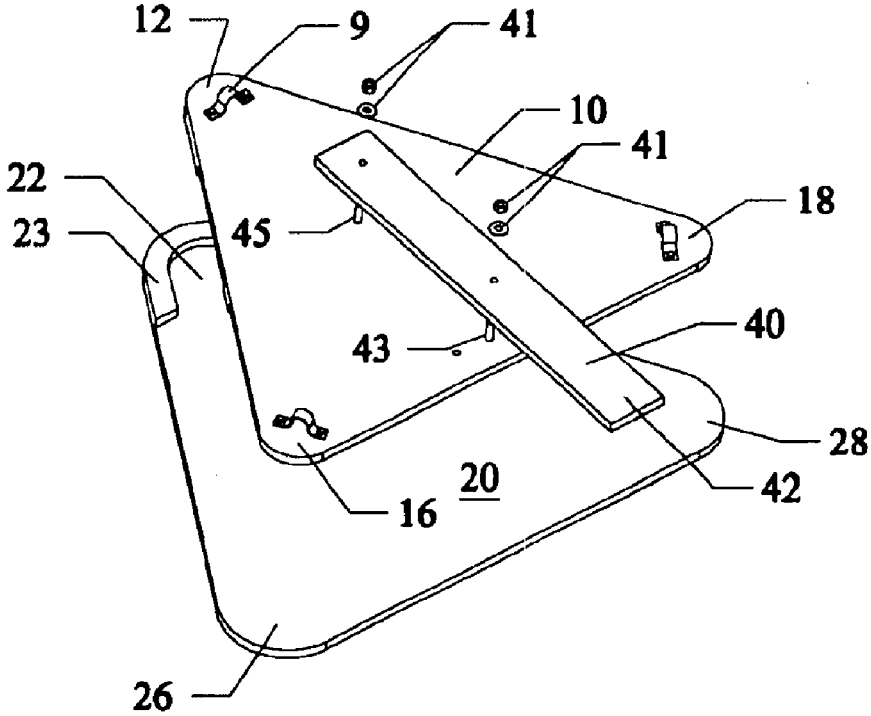
FIG. 6 is an exploded top perspective view of the pitching platform of FIGS. 1–2.

FIG. 3 is a top view showing the upper triangular member 10 of the pitching stand platform 1 of FIGS. 1–2. FIG. 4 is a bottom view of the lower triangular member 20 of the pitching stand platform 1 of FIGS. 1–2. FIG. 5 is an exploded bottom perspective view of the pitching platform 1 of FIGS. 1–4. FIG. 6 is an exploded top perspective view of the pitching platform 1 of FIGS. 1–2.

Referring to FIGS. 3–6, platform 1 can include an upper triangular shaped substantially planar member 10 having a front tip end 12 with downwardly directed thicker portion, a horizontal cross-beam section 14 across a mid-section, and base corner ends 16 and 18, each having spring members 17, 19 attached to an undersurface. A kick board member 40 can be attached to the upper surface of the upper triangular member 10 by various fasteners 41, 43, 45, such as screws, bolts, nuts, and the like. One end 42 of the kick board member 40 can extend rearwardly away from upper triangular member 10.

Bottom triangular shaped planar member 20 can also be triangular shaped and be slightly larger than the upper planar member 10. Bottom triangular member 20 can include a tip end 22 having a raised curved edge 23 which can be sized to allow tip end 12 to fit within. Base corner ends 26 and 28 of lower member 20 are initially located to be beneath like base corner ends 16, 18 of upper member 10. A central longitudinal bolt/screw 45 attaches kick member 40 to upper triangular member 10 through cross-brace member 14 to lower triangular member 20, so that upper and lower triangular members 10, 20 can rotate relative to one another, and/or pivot relative to one another. Footers 25 such as rubber pads, and the like, can protrude downward from the corners of lower triangular member 20 to aid in supporting the platform 1 on uneven ground surfaces.

Figure 7:
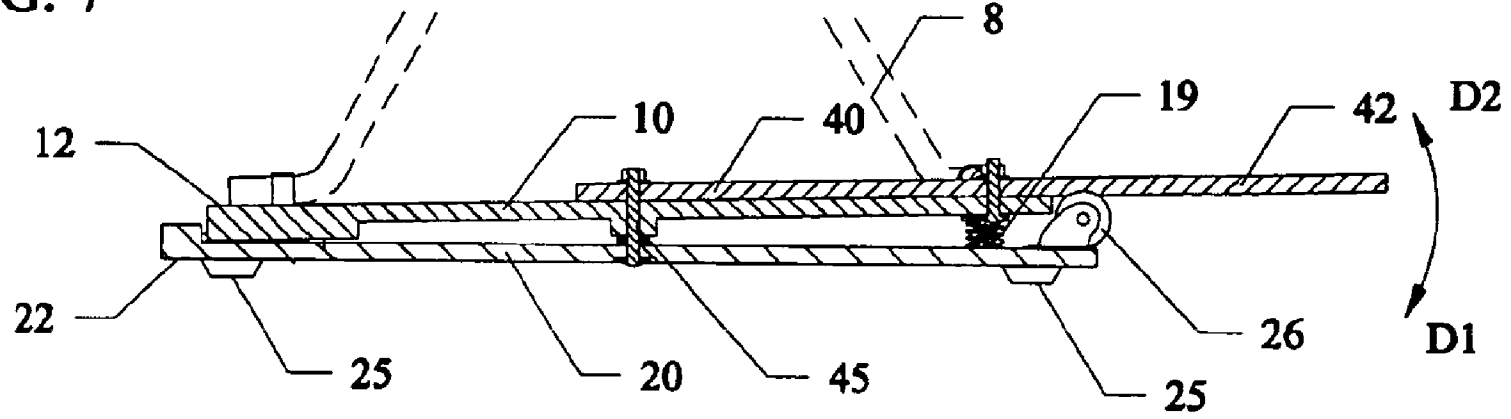
FIG. 7 is a cross-sectional view of the pitching stand platform of FIG. 3 along arrows 5×in an initial state.
Figure 8:
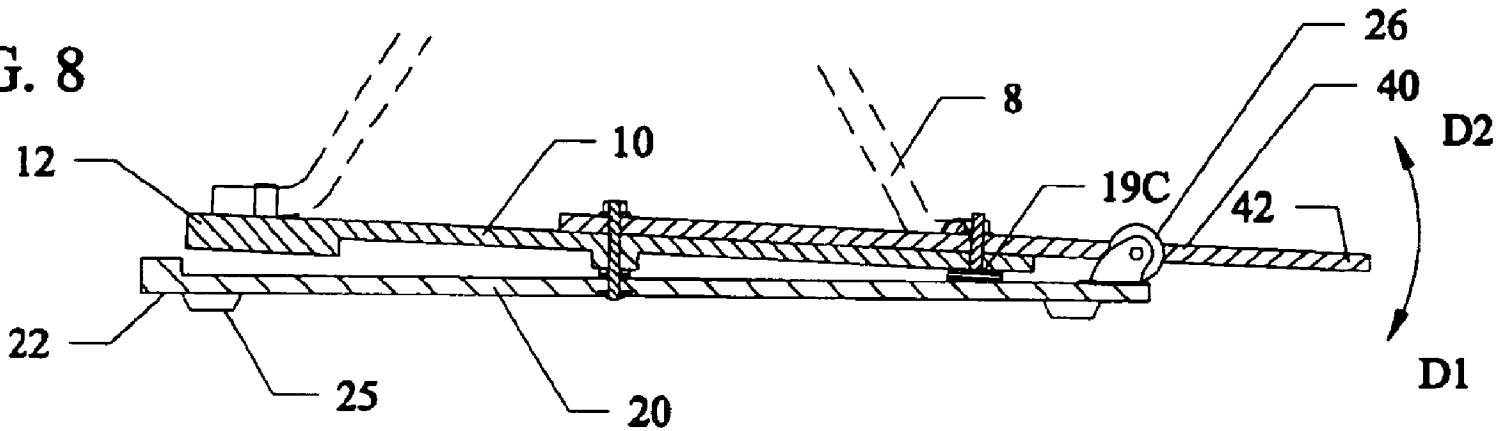
FIG. 8 is a view of the pitching stand platform of FIGS. 3 and 5 along arrows 5×in a fully depressed state.
Figure 9:
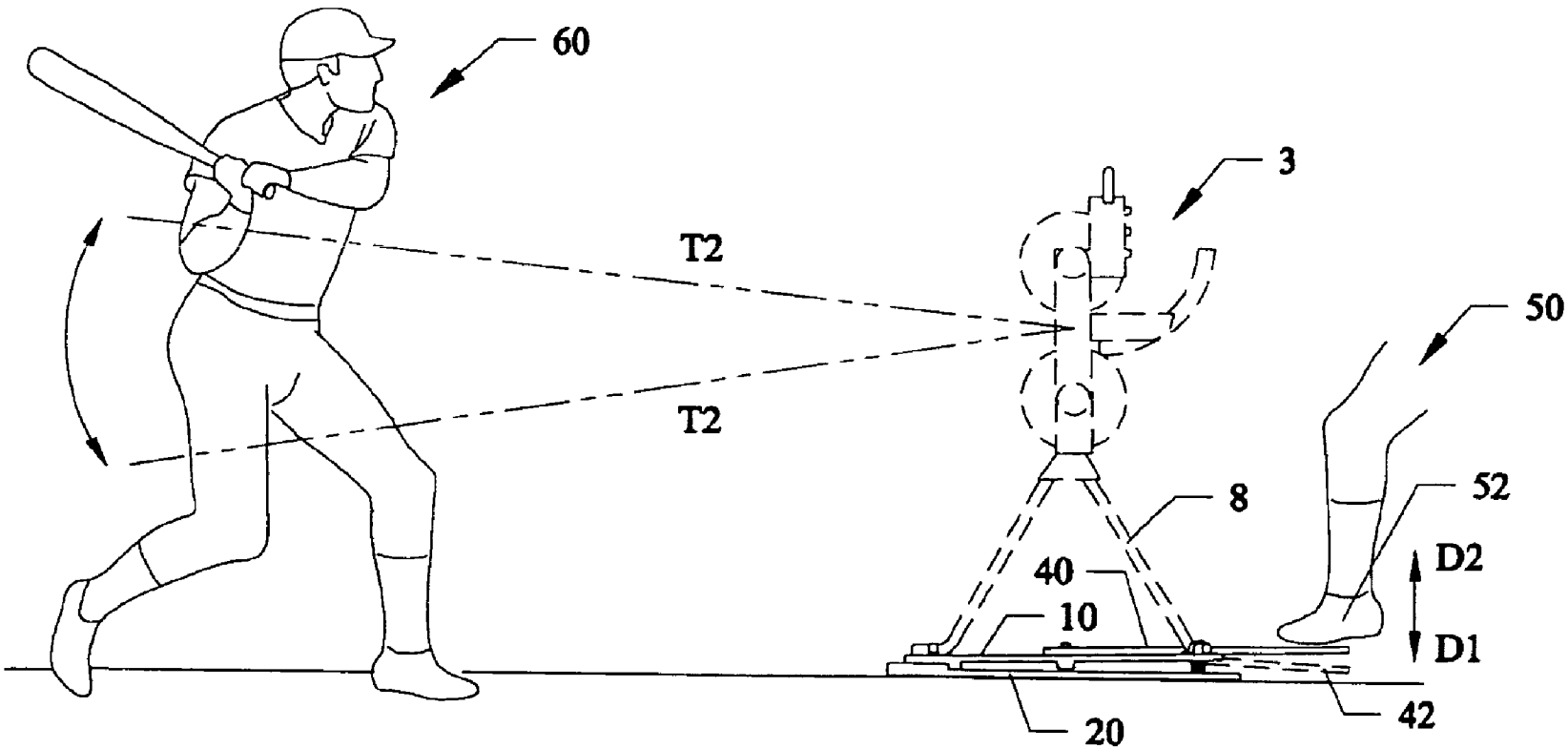
FIG. 9 is a side view of a coach user raising and lowering the upper member of the pitching platform that supports the ball dispensing machine of the preceding figures.

FIG. 7 is a cross-sectional view of the pitching stand platform 1 of FIG. 3 along arrows 5×in an initial state showing spring 19 extended. FIG. 8 is a view of the pitching stand platform 1 of FIGS. 3 and 5 along arrows 5×in a fully depressed state with spring 19C in a compressed state. FIG. 8 also shows an optional wheel 26 attached to an undersurface of the member 20 for allowing the platform to be easily moveable when tilted to one side. FIG. 9 is a side view of a coach/user 50 raising and lowering the upper member 10 of the pitching platform 1 that supports the ball dispensing machine 3 of the preceding figures.

Referring to FIGS. 7–9, the ball dispensing machine 3 mounted to platform 1 can initially deliver pitched balls along a downwardly angled trajectory T1 to the batter 60: A coach/user 50 can depress rearwardly extending end 42 of kick board 40 with their foot 52 in the direction of arrow D1 causing front tip end 12 of upper triangular member 10 to raise upward away from front tip end 22 of bottom triangular member 20 causing pitched balls to travel along an upwardly sloped directory T2 to batter 60. The coach/user 50 can incrementally adjust the trajectories T1 and T2 to be at various angles as desired by moving their foot upward and downward in the direction of arrows D1 to D2 and back, which will enhance the versatility of the ball player 60. The coach/user 50 does not have to shut down and/or physically adjust and/or physically move the ball dispensing machine 3 between pitched balls so that the player 60 can hit different trajectory pitched balls one after another in rapid succession, without delay time occurring between the pitched balls.

Figure 10A:
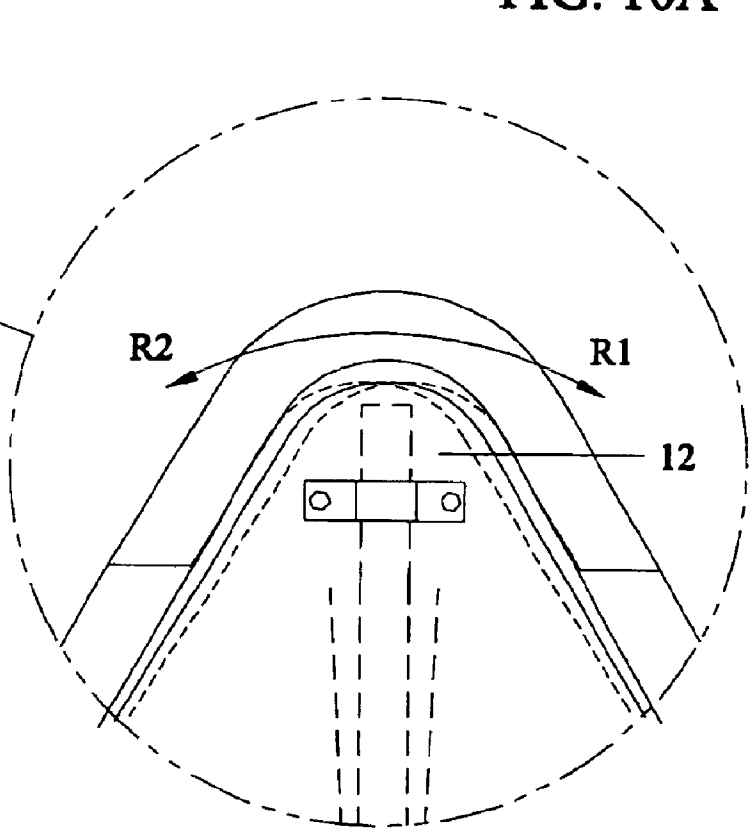
FIG. 10A is an enlarged view of the front tip section of the pitching platform of FIG. 10.
Figure 10:
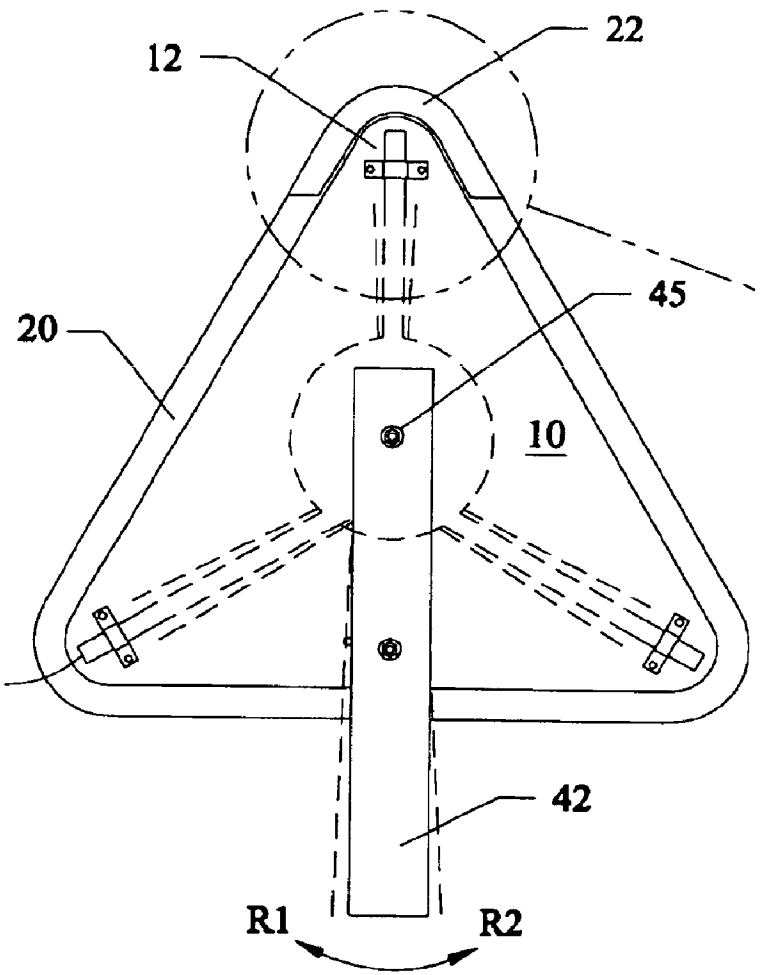
FIG. 10 shows a top view of the pitching stand platform being rotated along a horizontal axis.
Figure 11:
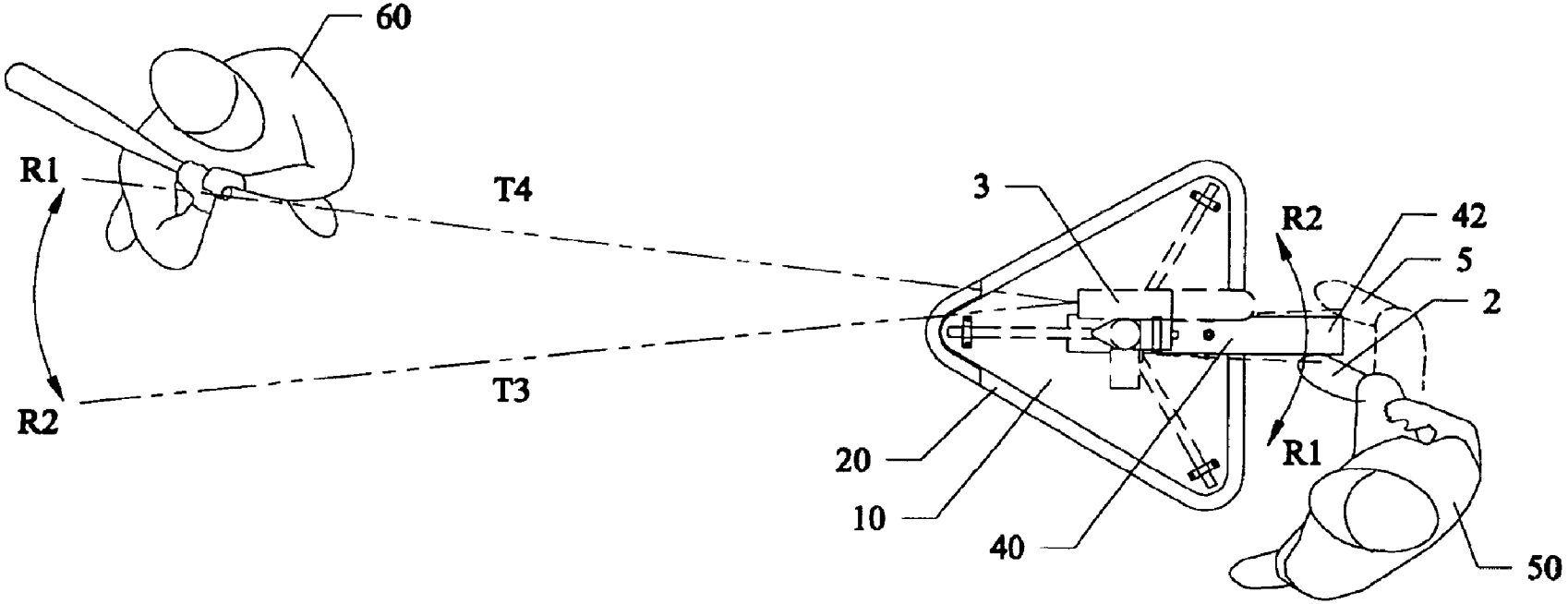
FIG. 11 is a top view of a coach/user rotating the upper member of the pitching platform that supports the ball dispensing machine of the preceding figures.

FIG. 10 shows a top view of the pitching stand platform 1 being rotated along a horizontal axis R1-R2. FIG. 10A is an enlarged view of the front tip section 12 of the pitching platform 1 of FIG. 10. FIG. 11 is a top view of a coach/user 50 rotating the upper member of the pitching platform 1 that supports the ball dispensing machine 3 of the preceding figures.

Referring to FIGS. 10, 10A, and 11, the coach/user 50 can move their foot 52 side to side on opposite ends of rearwardly facing end 42 of kick board 40 in order to rotate upper triangular member 10 relative to lower member 20 along rotation axis about screw/bolt 45 so that moving board end 42 in the direction of arrow R1 moves the tip end 12 of upper triangular member 10 in the direction of arrow R2, and moving board end 42 in the direction of arrow R2 moves the tip end 12 of upper triangular member 10 in the direction of arrow R1. As shown in FIG. 11, the coach/user 50 can incrementally adjust the trajectories T3 and T4 to move along various horizontal axes as desired by sliding their foot 52 in the direction of arrows R1 to R2 and back, which will enhance the versatility of the ball player 60. The coach/user 50 does not have to shut down and/or physically adjust and/or physically move dispensing machine 3 between pitched balls so that the player 60 can hit different trajectory pitched balls one after another in rapid succession without any delay time occurring between the pitched balls.

Second Embodiment

Figure 12:
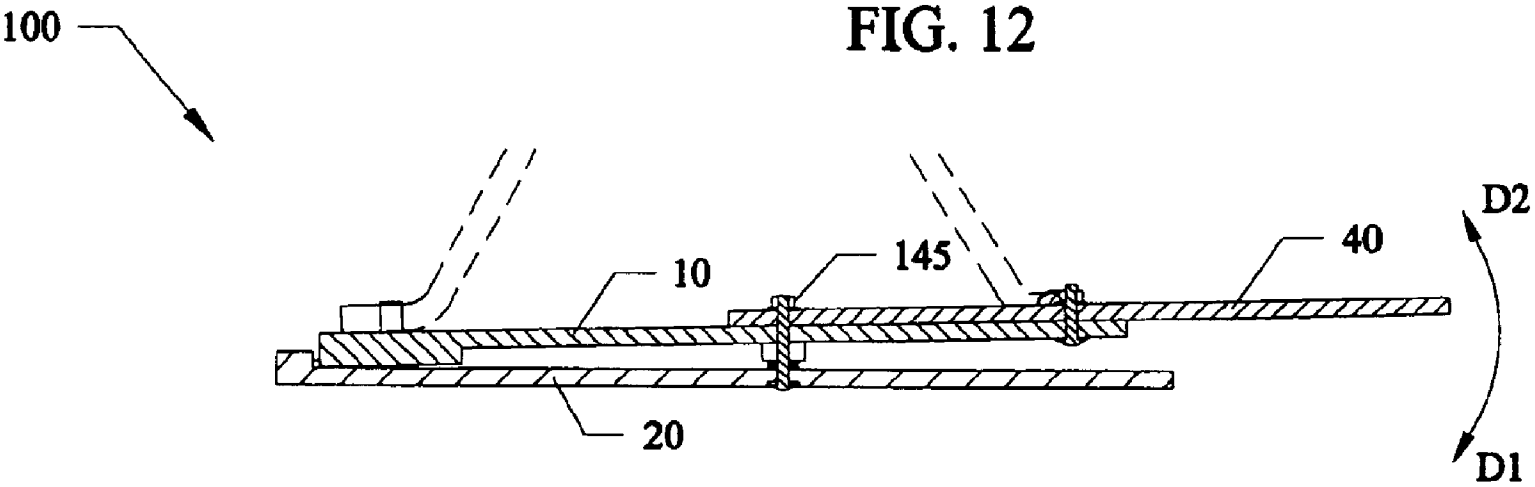
FIG. 12 is a cross-sectional view of a second embodiment pitching stand platform of the invention in an initial state.
Figure 13:
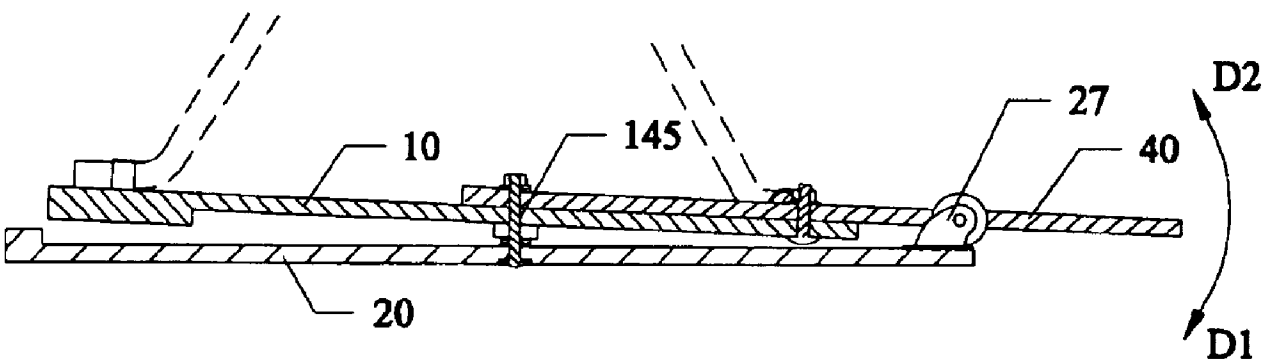
FIG. 13 is a view of the pitching stand platform of FIG. 7 in a fully depressed state.

FIG. 12 is a cross-sectional view of a second embodiment pitching stand platform 100 of the invention in an initial state. FIG. 13 is a view of the pitching stand platform 100 of FIG. 7 in a fully depressed state. FIG. 13 also shows an optional wheel 27 attached to an upper surface edge of the member 10 for allowing the platform to be easily moveable when tilted to one side. Referring to FIGS. 12–13, second embodiment platform 100 can be similar to that of the first embodiment 1 without having spring members 17, 19. The upper triangular member 10 can pivot and/or rotate relative to the lower triangular member 20 by the central bolt/screw 145, which can be a flexible springable fastener, and the like. Embodiment 100 can function similarly to that described in reference to the first embodiment 1 described above.

Third Embodiment

Figure 14:
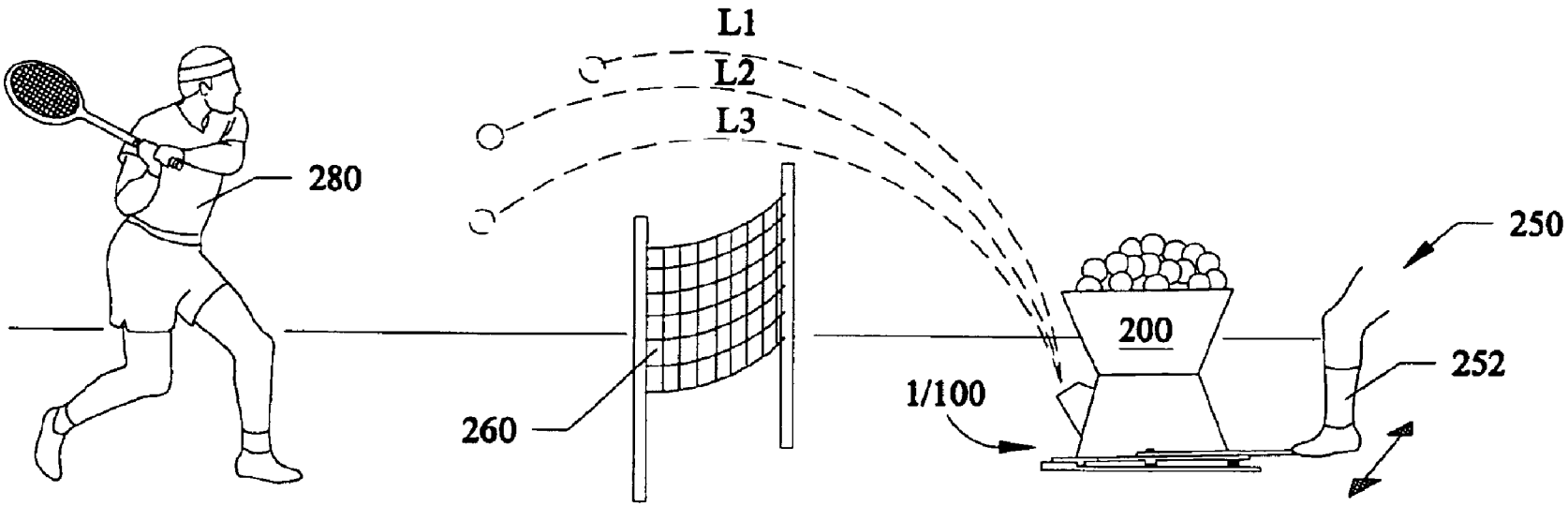
FIG. 14 shows a third embodiment application of supporting a tennis ball dispensing machine with the novel pitching stand platform of the preceding figures.

FIG. 14 shows a third embodiment application of supporting a tennis ball dispensing machine 200 with the novel pitching stand platform 1/100 of the preceding figures. Here, an off-the-shelf type tennis ball dispensing machine can be continuously fed by a hopper having multiple tennis balls being dispensed one after the other. Similar to the previous figures, a coach/user 250 can selectively use their foot to move a kick board on the platform 1/100 up/down and/or right/left adjust the vertical and/or horizontal trajectories L1, L2, L3 of tennis balls being dispensed by the tennis ball pitching machine 200 over the net 260 to a tennis player 280. The pitching stand platform 1/100 can be used to enhance the versatility of the player 280 to hit back and return tennis balls coming in from different angles. The coach/user 250 does not have to shut down and/or physically adjust and/or physically move dispensing machine 200 between pitched balls so that the player 280 can hit different trajectory pitched tennis balls one after another in rapid succession without any delay time occurring between the pitched tennis balls.

The invention can be made with different materials for the platform upper and lower triangular members, and kick board. For example, materials such as but not limited to plastic, fiberglass, wood, compositions, and the like, can be used for these components.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A method of immediately changing trajectories of balls being dispensed by a ball dispensing machine, comprising the steps of:

supporting the ball dispensing machine on a support member;

adjusting trajectories of the balls being dispensed by the dispensing machine;

changing the trajectories of the balls being dispensed by the dispensing machine without loss of time between delivery of the balls being dispensed by the machine, and without having to physically handle the machine; and moving a foot control attached to the support member to adjust the changing of the trajectories of the dispensed balls.

2. The method of claim 1, wherein the step of adjusting the trajectories includes the step of: adjusting the trajectories along a vertical axis relative to a ground surface.

3. The method of claim 1, wherein the step of adjusting the trajectories includes the step of: adjusting the trajectories along a horizontal axis relative to a ground surface.

4. The method of claim 1, wherein the step of adjusting the trajectories includes the step of: adjusting the trajectories along both vertical and horizontal axes relative to a ground surface.

5. The method of claim 1, wherein the adjusting step includes the step of: pivoting the dispensing machine up and down relative to a ground surface.

6. The method of claim 1, wherein the adjusting step includes the step of: swiveling the dispensing machine in a horizontal direction relative to a ground surface.

7. The method of claim 1, wherein the adjusting step includes the steps of: pivoting and swiveling the dispensing machine relative to the ground surface.

8. The method of claim 1, wherein the supporting step includes the step of: supporting a tennis ball dispensing machine on the support member.

9. The method of claim 1, wherein the supporting step includes the step of: supporting at least one of: a softball dispensing machine and a baseball dispensing machine on the support member.

10. The method of claim 9, wherein the supporting step includes the step of: attaching bottom ends of legs protruding downward from the ball dispensing machine to the planar platform.

11. The method of claim 9, wherein the adjusting step further includes the step of: extending the member rearwardly from the platform.

12. The method of claim 11, further comprising the step of:

moving the rearwardly extending member with a foot of an operator.

13. An apparatus for adjusting a trajectory delivery of balls being dispensed by an existing ball pitching machine, comprising:

a platform for supporting the ball pitching machine on a ground surface;

a trajectory control member underneath the platform for adjusting trajectory delivery of balls being dispensed by the ball pitching machine, wherein the adjusting occurs without having to physically handle the machine and without having to delay the delivery of the balls being continuously dispensed by the machine; and a movable foot control adjacent to the ground surface for controlling the trajectory control member by a foot of a user, wherein moving the foot control changes and adjusts trajectories of the dispensed balls from the machine.

14. The apparatus of claim 13, wherein the trajectory control member includes:

a pivotable member for pivoting the dispensing machine up and down relative to the ground surface.

15. The apparatus of claim 13, wherein the trajectory control member includes:

a swivel member for swiveling the dispensing machine in a horizontal direction relative to the ground surface.

16. The apparatus of claim 13, wherein the trajectory control member includes:

a pivotable and swivel member for pivoting and swiveling the dispensing machine relative to the ground surface.

17. The apparatus of claim 13, further comprising:

an arm connected to the foot control and extending rearwardly from the platform.

18. The apparatus of claim 13, further comprising:

mounting members for mounting each leg of the dispensing machine to the platform.

* * * * *